US006863231B2

(12) United States Patent
Schaefer

(10) Patent No.: US 6,863,231 B2
(45) Date of Patent: Mar. 8, 2005

(54) GADGET FOR WASHING MIXING CONTAINERS

(75) Inventor: Klaus Schaefer, Wuppertal (DE)

(73) Assignee: Schicker & Schaefer GmbH, Wuppertal (DE)

( * ) Notice: Subject to any disclaimer, the term of this patent is extended or adjusted under 35 U.S.C. 154(b) by 0 days.

(21) Appl. No.: 10/300,604

(22) Filed: Nov. 20, 2002

(65) Prior Publication Data

US 2003/0164413 A1 Sep. 4, 2003

(30) Foreign Application Priority Data

Nov. 25, 2001 (DE) ..... 201 19 146

(51) Int. Cl.[7] ..... A62C 31/02

(52) U.S. Cl. ..... 239/601; 134/198; 239/240; 239/553.5; 239/560; 239/561; 239/567

(58) Field of Search ..... 134/198; 239/553.5, 239/601, 560, 561, 567, 237, 240, 251

(56) References Cited

U.S. PATENT DOCUMENTS 1,380,004 A * 5/1921 Moork ..... 239/553.5
3,603,512 A * 9/1971 Ham ..... 239/561
3,771,725 A * 11/1973 Jenkins et al. ..... 239/251
4,056,229 A * 11/1977 Jones ..... 239/567
4,087,049 A * 5/1978 Traina ..... 239/567
4,422,466 A 12/1983 Schafer ..... 134/170
4,637,552 A * 1/1987 Finkbeiner et al. ..... 239/553.5
5,947,136 A * 9/1999 Abras ..... 134/198
2003/0164413 A1 * 9/2003 Schaefer ..... 239/553.5

FOREIGN PATENT DOCUMENTS

DE 31 31 333 8/1981

* cited by examiner

*Primary Examiner*—Sheldon J Richter
(74) *Attorney, Agent, or Firm*—Jordan and Hamburg LLP

(57) ABSTRACT

Rinsing equipment, especially for mixing containers, including a socket housing with an interior pressure rinsing valve and an upright valve tube, wherein a spraying plate is seated on this valve tube. The spraying plate may have a trough-shaped depression or run out into star-shaped guiding cross members. The spraying equipment may include several upwardly or horizontally directed nozzles. The spraying plate may also include a water distribution chamber.

17 Claims, 3 Drawing Sheets

GADGET FOR WASHING MIXING CONTAINERS

BACKGROUND OF THE INVENTION

In the area of gastronomy, rinsing equipment or dishwashing machines are usually used to clean containers, especially drinking glasses, pitchers and the like.

Because of the lip contact which has taken place with drinking glasses, and encrusted beverage residues, thorough cleaning and also preferably disinfecting is of primary importance as a first step here and rinsing in a subsequent second step is of lesser importance.

Drinking vessels usually have a smooth, rounded inner contour, with which good cleaning results can be achieved. They are therefore cleaned with brushes or with hot water.

Known solutions for this are found, for example, in German patent P 31 31 333.7 and in U.S. Pat. No. 4,422,466 or in German utility patent 299 10 403.6 or in the European patent application corresponding to International Application No. PCT/EP 00/04706.

On the other hand, there is no lip contact in the case of mixing containers and the cleaning step is therefore of no importance, whereas the rinsing step is important and, at the same time, difficult because of the complicated, tiered inner contour of these containers.

Different mixed drinks are prepared alternately in these mixing containers, which must be rinsed intensively in order to avoid affecting the taste of the drinks. The problem of rinsing arises out of the special contour of the mixing containers; for example, the bottom has a tiered chamber, in which impact knives for comminuting ice and pieces of fruit rotate (see FIG. 1). For this reason, this chamber is practically inaccessible to brushes like those used in known glass rinsing equipment.

SUMMARY OF THE INVENTION

The invention therefore is based on the need for thoroughly rinsing mixing containers with a difficult, tiered inner contour.

This objective is accomplished pursuant to the invention by rinsing equipment including a socket housing with an interior pressure rinsing valve and an upright valve tube, and a spraying plate seated on the valve tube, the spraying plate having star-shaped guiding cross members. The objective is also accomplished by a spraying plate including a trough-shaped depression and star-shaped guiding cross members.

BRIEF DESCRIPTION OF THE DRAWINGS

The invention is explained in greater detail by means of an advantageous embodiment and FIGS. 1 to 4 enclosed, in which.

DETAILED DESCRIPTION OF THE INVENTION

Figure 1:
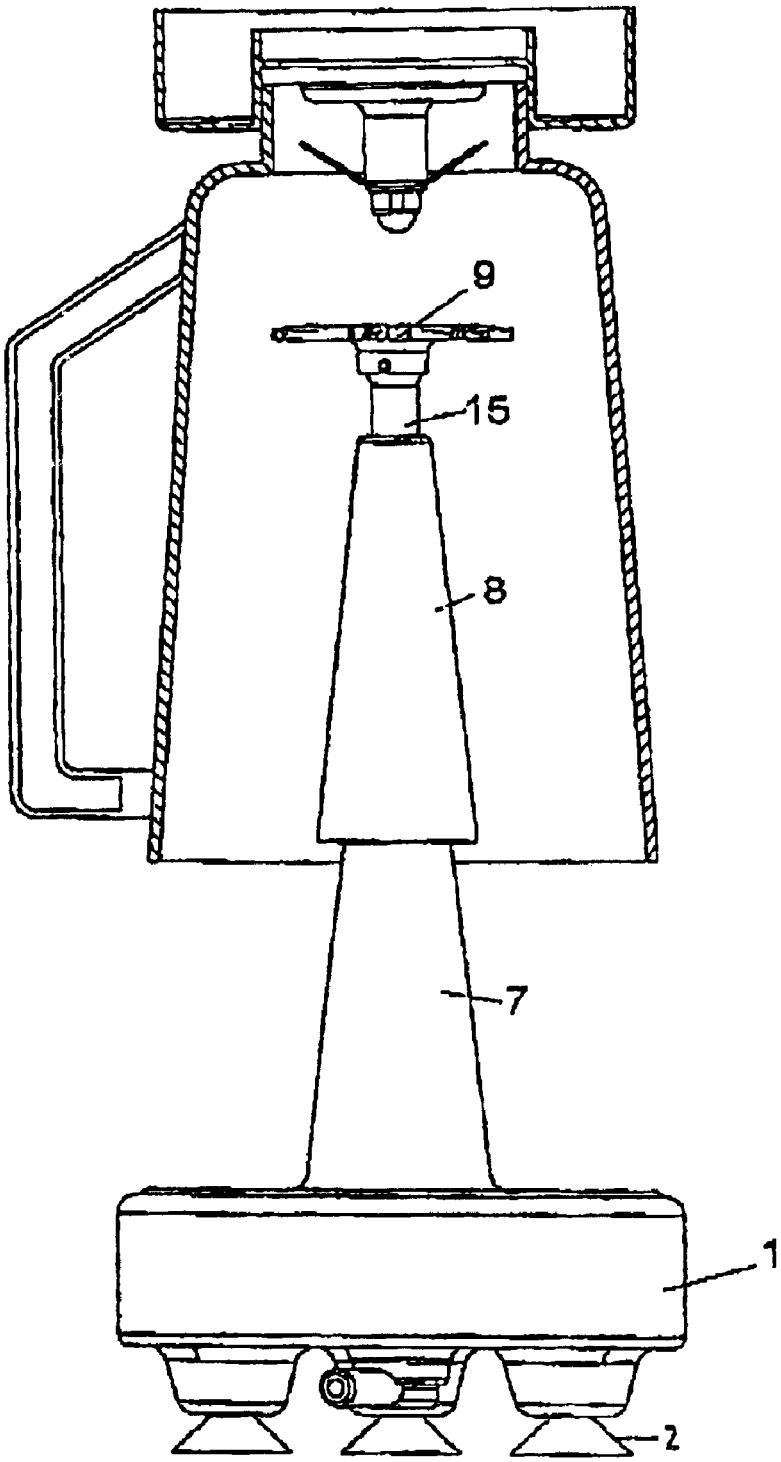
FIG. 1 shows a view of the rinsing equipment in accordance with the invention over which the mixing container is inverted (section), the impact knife chamber of the mixing container being well recognizable.

The rinsing equipment of the invention, described here, comprises a socket housing (1) (FIG. 1), which rests with several suction cup holders (2), for example, on the bottom of the sink. In the socket housing (1), there is a pressure rinsing valve (4), which is opened by a lifting motion of a valve tube (6) and frees the path for the rinsing water. This lifting motion is initiated by inverting and pressing down a vessel (mixing container, FIG. 1) on a spraying plate (9), a communicating piece (15) of which is fastened to the valve tube (6) in a known manner.

A guiding cylinder (5), in which the valve tube (6) can move up and down, is disposed on the socket housing (1). The guiding cylinder (5) is surrounded by an elastic, plastic glass protection (7), which is also cylindrical and prevents breakage of or damage to the vessels. Further towards the top, a second, elastic glass protection (8) is mounted, which has essentially the same function as the first glass protection (7).

Figure 2:
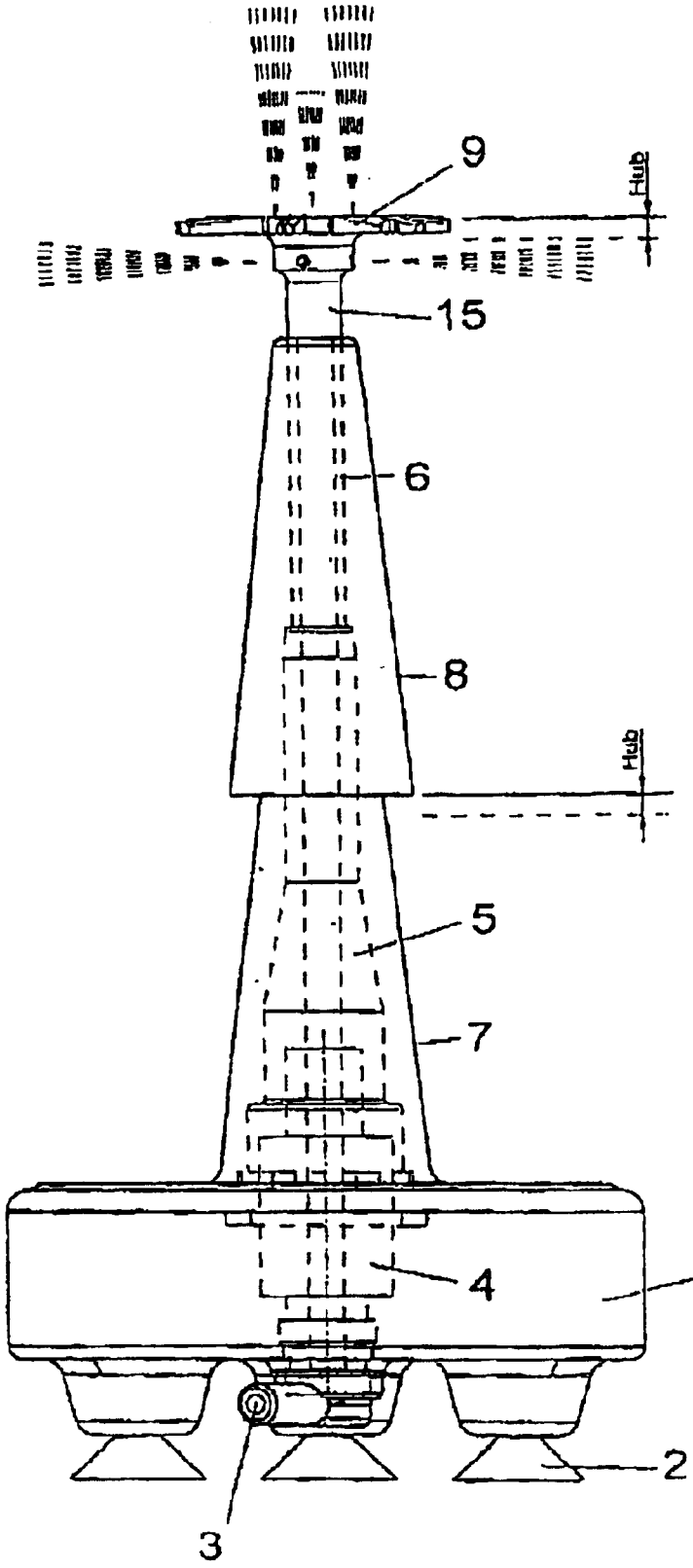
FIG. 2 illustrates the construction of the rinsing equipment in accordance with the invention and shows the emerging water jets for rinsing the mixing container and FIGS. 3 and 4 show the construction of an advantageous embodiment of the spraying plate for rinsing equipment in accordance with the invention.
Figures 3, 4:
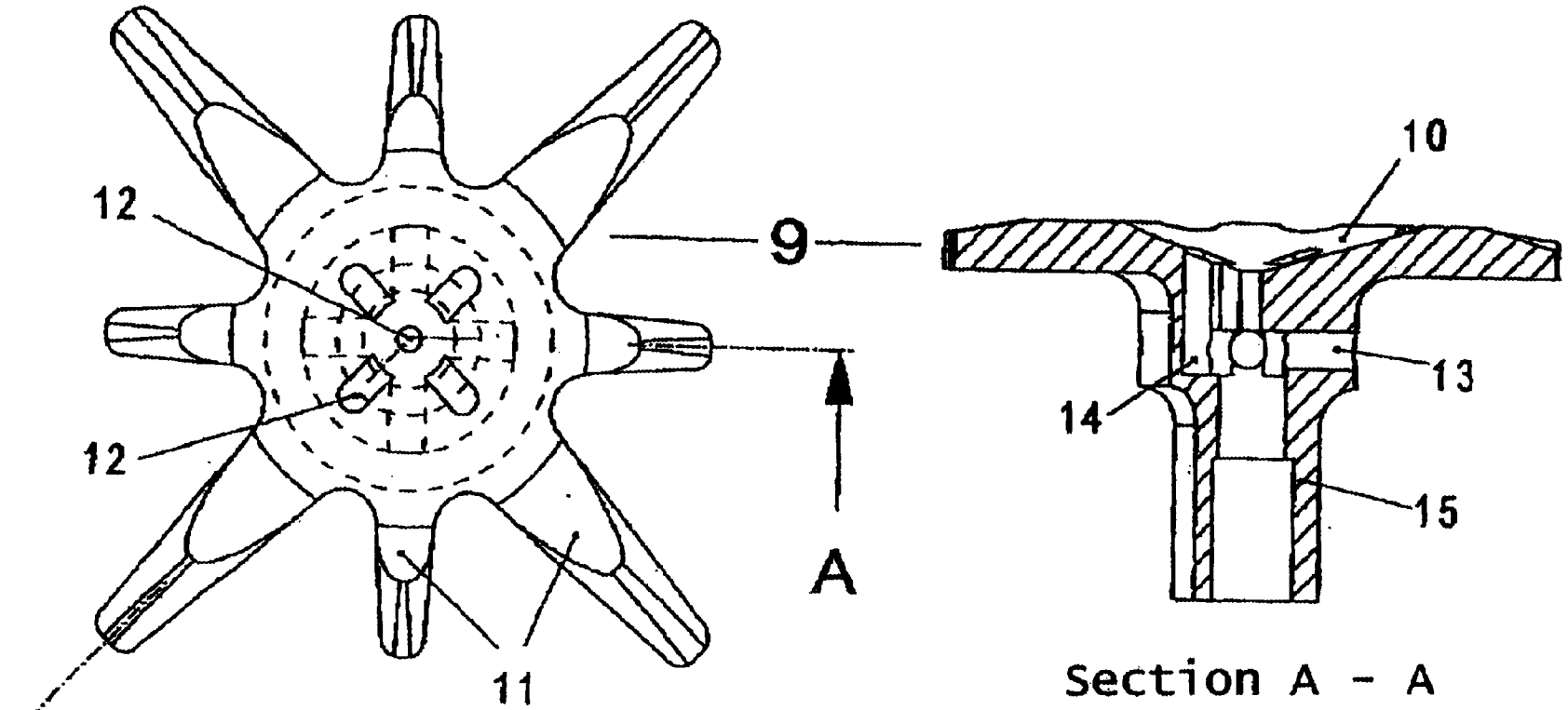

At the upper end of the valve tube (6), the star-shaped spraying plate (9) is fastened and, when depressed over the valve tube (6), opens the valve (4) and, in this manner, opens up a path for rinsing water for spraying out and rinsing the mixing container. The rinsing water sprays out of the spraying plate (9) (FIG. 2) in two directions. On one hand, it sprays upward out of the nozzles (12) in the direction of the impact knife chamber of the mixing container. At the same time, the water jets also partly strike the inclined knives and, at the same time, are swirled, which produces an exceptional mixing action in this impact knife chamber and is of decisive importance for the desired rinsing result. On the other, the rinsing water sprays horizontally out of the nozzles (13) for rinsing out the container wall. The water distribution chamber (14) assigns the rinsing water to nozzles (12) and (13).

It is an important prerequisite for the actuation of the valve (4) that the spraying plate (9) is constructed so that the cap nut of the knife mechanism in the mixing container (FIG. 1) strikes the spraying plate (9) reliable and centrally. In this connection, the star-shaped cross members (11) initially guide the mixing container roughly and the trough-shaped depression (10) then ensures that this cap nut is captured centrally. The trough (10) may be very flat and have any shape. The cross members (11) may be straight, as shown, or also bent at right angles, curved or arc-shaped. The areas between the guiding cross members (11) provide sufficient space for those impact knives, which are directed not within the impact knife chamber but in the opposite direction.

The spraying plate (9) can also be used for any other rinsing units of a different construction.

The inventive spraying equipment represents an easily handled, advantageous and economic solution for rinsing containers, especially mixing containers. Due to the use of the inventive spraying plate (9), it is also possible to rinse containers having a complicated shape, especially mixing containers, efficiently with any rinsing units.

What is claimed is:

1. Rinsing equipment, comprising:

a socket housing with an interior pressure rinsing valve and an upright valve tube; and a spraying plate seated on the valve tube, the spraying plate having star-shaped guiding cross members.

2. The rinsing equipment of claim 1, wherein the rinsing equipment is used for mixing containers.

3. The rinsing equipment of claim 1, wherein the star-shaped guiding cross members are straight and project from a central part of the spraying plate.

4. The rinsing equipment of claim 1, wherein the spraying plate has a trough-shaped depression.

5. The rinsing equipment of claim 4, wherein the trough-shaped depression is formed in an upper surface of the spraying plate.

6. The rinsing equipment of claim 4, wherein the spraying plate includes a plurality of upwardly directed nozzles opening into the trough-shaped depression.

7. The rinsing equipment of one of claims 1 and 4, wherein the spraying plate includes a plurality of upwardly directed nozzles.

8. The rinsing equipment of one of claims 1 and 4, wherein the spraying plate includes a plurality horizontally directed nozzles.

9. The rinsing equipment of one of claims 1 and 4, wherein a central part of the spraying plate has a water distribution chamber.

10. A spraying plate for any rinsing units, comprising:

a trough-shaped depression; and star-shaped guiding cross members.

11. The spraying plate of claim 10 further comprising a plurality of upwardly directed nozzles.

12. The spraying plate of claim 10, further comprising a plurality of horizontally directed nozzles.

13. The spraying plate of claim 10, wherein a central part of the spraying plate has a water distribution chamber.

14. The spraying plate of claim 10, wherein the upwardly directed nozzles open into the trough-shaped depression.

15. A rinsing apparatus, comprising:

a socket housing with an interior pressure rinsing valve and an upright valve tube; and a spraying plate seated on the valve tube, the spraying plate including a plurality of horizontally directed nozzles.

16. The apparatus of claim 15, wherein the spraying plate includes a trough-shaped depression formed on an upper portion, the horizontally directed nozzles being arranged entirely below the upper portion of the spraying plate on which the depression is formed.

17. A spraying plate for a rinsing unit, comprising:

a trough-shaped depression formed on an upper portion;

a plurality of upwardly directed nozzles opening into the trough-shaped depression; and a plurality of horizontally directed nozzles arranged entirely below the upper portion of the spraying plate on which the depression is formed.

* * * * *